US006526147B1

(12) United States Patent
Rung

(10) Patent No.: US 6,526,147 B1
(45) Date of Patent: Feb. 25, 2003

(54) MICROPHONE ARRAY WITH HIGH DIRECTIVITY

(75) Inventor: Martin Rung, Bronshoj (DK)

(73) Assignee: GN Netcom A/S (DK)

( * ) Notice: Subject to any disclaimer, the term of this patent is extended or adjusted under 35 U.S.C. 154(b) by 0 days.

(21) Appl. No.: 09/191,208

(22) Filed: Nov. 12, 1998

(51) Int. Cl.[7] ..... H04R 3/00
(52) U.S. Cl. ..... 381/92; 381/111
(58) Field of Search ..... 381/92, 122, 111–117, 381/26, 91, 356, 147, 148, 151

(56) References Cited

U.S. PATENT DOCUMENTS

| | | | | | |
|---|---|---|---|---|---|
| 4,311,874 | A | * | 1/1982 | Wallace | 179/1 |
| 4,559,642 | A | | 12/1985 | Miyaji et al. | 381/92 |
| 5,058,170 | A | * | 10/1991 | Kanamori et al. | 381/92 |
| 5,581,620 | A | | 12/1996 | Brandstein et al. | 381/92 |
| 5,657,393 | A | | 8/1997 | Crow | 381/92 |
| 6,069,961 | A | * | 5/2000 | Nakazawa | 381/92 |
| 6,317,501 | B1 | * | 11/2001 | Matsuo | 381/92 |

FOREIGN PATENT DOCUMENTS

| | | |
|---|---|---|
| DE | 821 219 | 7/1949 |
| DE | 36 33 991 | 4/1988 |
| EP | 0 781 070 | 6/1997 |

OTHER PUBLICATIONS

"A Microphone Array for multimedia Workstations" Journal Audio Engineering Society, vol. 44, No. 5, May 1996, pp. 365–372.

"Design of Logarithmically Spaced Constant–Directivity Transducer Attays" Journal Audio Engineering Society, vol. 44, No. 6, Jun. 1996, pp. 497–507.

* cited by examiner

*Primary Examiner*—Duc Nguyen
*Assistant Examiner*—Lun-See Lao
(74) *Attorney, Agent, or Firm*—Altera Law Group LLC

(57) ABSTRACT

Microphone array which comprises a multiple of microphones which are arranged in an elongated element or housing, in which the individual microphones in the microphone array are arranged in pairs. The individual microphones in each pair are disposed on each their side of a centerline for the microphone array, where the signals from the microphones are summated in the formation of the output signal from the microphone array. The microphones on each side of the centerline of the microphone array are disposed with non-equidistant spacing between them, and low-pass filters are coupled between each microphone and a summation link, in that the microphones associated with one and the same pair are connected to low-pass filters having the same cut-off frequency. The cut-off frequency for the low-pass filters is different for each pair of microphones, in that the cut-off frequency is lowest for that pair of microphones which lie furthest away from the centerline, and is higher the closer the pair of microphones lies to the centerline. The microphone array is arranged in such a manner that the distances between the microphones and the cut-off frequencies for the low-pass filters are mutually adjusted in relation to one another.

8 Claims, 7 Drawing Sheets

MICROPHONE ARRAY WITH HIGH DIRECTIVITY

Figure 1A:
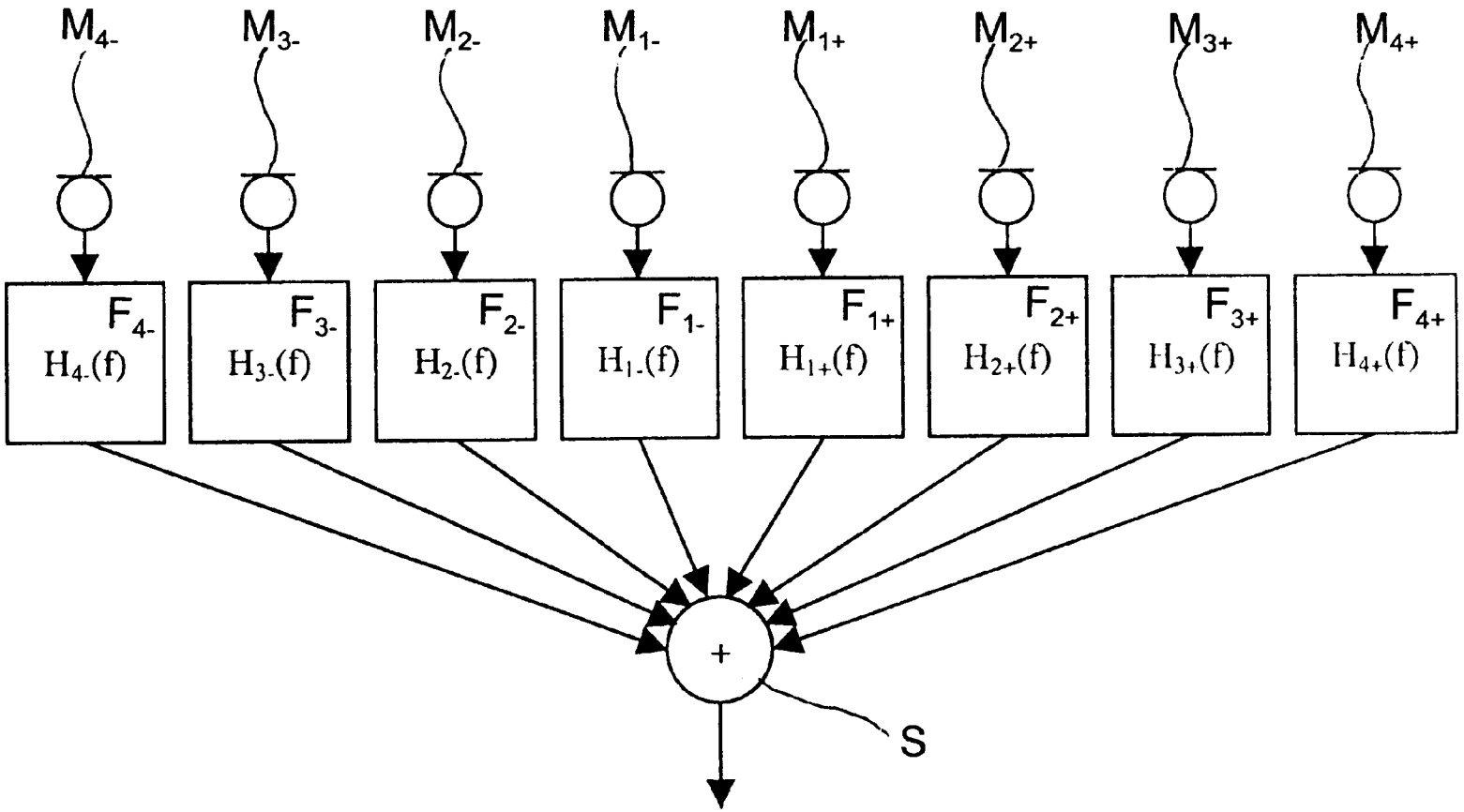

The invention concerns a microphone array which comprises a multiple of microphones which are arranged in an elongated element or housing. The individual microphones in the microphone array are arranged in pairs, in that the individual microphones in each pair are placed on each their sides of a centreline for the microphone array, and in that the signals from the microphones are summated to form an output signal for the microphone array.

Microphone arrays of this type, which use direct summation of the signals from a finite number of microphones, display a directivity which is dependent on the frequency. The directivity generally depends on the effective length of the array and the acoustic wavelength at the relevant frequency. There is thus achieved only a minor degree of directivity at low frequencies (i.e. at frequencies where the wavelength L is much greater than the length of the array), and the directivity increases with the frequency until there is achieved a very high degree of directivity at wavelengths which are much shorter than the length of the array.

The lowest wavelength at which the microphone array can provide a certain degree of directivity is dependent on the overall length of the array, and the highest frequency at which the directional characteristic does not have significant side lobes is dependent on the distance between the microphones in the array.

The length of the array and the distance between the microphones (and herewith the number of microphones) thus depends on the frequency range in which a given directivity is desired within certain limits.

Such microphone arrays which are configured with the object of achieving a good directivity are used, for example, in connection with conferences and meetings, where a microphone is positioned to detect the sound from one or possibly more speakers, but not from speakers who are situated in another part of the room and who possibly use other microphones. Moreover, such microphone arrays are used in connection with teleconferences, video-conferences and the like where it is similarly desired to detect sounds from a speaking person without also picking up disturbing noise from other persons or background noise in general.

A special use will be in connection with personal computers and the like, where it can be envisaged that a microphone array can be placed in the vicinity of the screen, for example on top of it, so that speech from the user of the screen is detected by the microphone.

It is important for such applications that the microphone array is small in extent, so that it can easily be placed in an expedient position, and that it is of a reasonable price, which among other things means that it needs to be relatively simple in its configuration without containing too many and too complex components.

Microphone arrays of the kind defined in the introduction are known, for example, from U.S. Pat. No. 4,311,874, where use is made of a relatively large number of microphones in each microphone array in order to achieve the desired degree of directivity. The microphones in this array are arranged in such a manner that the distances between the microphones are not the same, i.e. not equidistant.

Furthermore, microphone arrays are known where the microphones are arranged at varying distances, and where the microphones are connected to different kinds of filters. This is known for example from DE publication No. 36 33 991, where use is made of bandpass filters with frequency bands which are adjacent to each other.

The object of the invention is to provide a microphone array which with relatively short length, with a relatively small number of microphones and relatively simple means, can display a high degree of directivity.

This is achieved with a microphone array which is configured as disclosed in claim 1. By filtering the microphone signals so that microphones, depending on their distance to the centre plane, are not active for higher frequencies, it is achieved that the effective length of the array can be held proportional to the wavelength over a certain frequency range, so that the directivity can be held constant over the relevant frequency range. Moreover, it is achieved that with a suitable choice of the precise positions of the microphones, and a correspondingly suitable choice of filter characteristics, the directivity can be determined depending on the frequency over a wide range, while at the same time the number of microphones is held at a suitably low level.

With an expedient embodiment as disclosed in claim 2, it is achieved that the microphone array has a constant directivity, i.e. independent of the frequency, up to an upper frequency $f_0$ with the use of a minimum number of microphones and with a given length of the array. The constant directivity is achieved from the frequency $f_0$ down to the frequency $f_0/3$. Moreover, it is achieved that the directivity is the highest possible in a frequency range from $f_0/3$ down to $f_0/10$. By using unidirectional microphones e.g. unidirectional 1. order gradient microphones, it is further achieved that the main lobe of the microphone array is associated with only one side of the array.

With the especially expedient embodiment as disclosed in claim 3, there is achieved a microphone array which has constantly high directivity in the range from 5000 Hz down to approx. 1670 Hz, and which furthermore has the highest possible degree of directivity from here and down to approx. 500 Hz, i.e. in an area in which a large part of the frequency range for human speech lies.

With another embodiment such as that disclosed in claim 6 and 7, there is achieved the further advantage for the user that it can be immediately ascertained whether the person concerned is situated in the area for the main lobe, which is very important when using microphone arrays with a high degree of directivity.

Figure 1B:
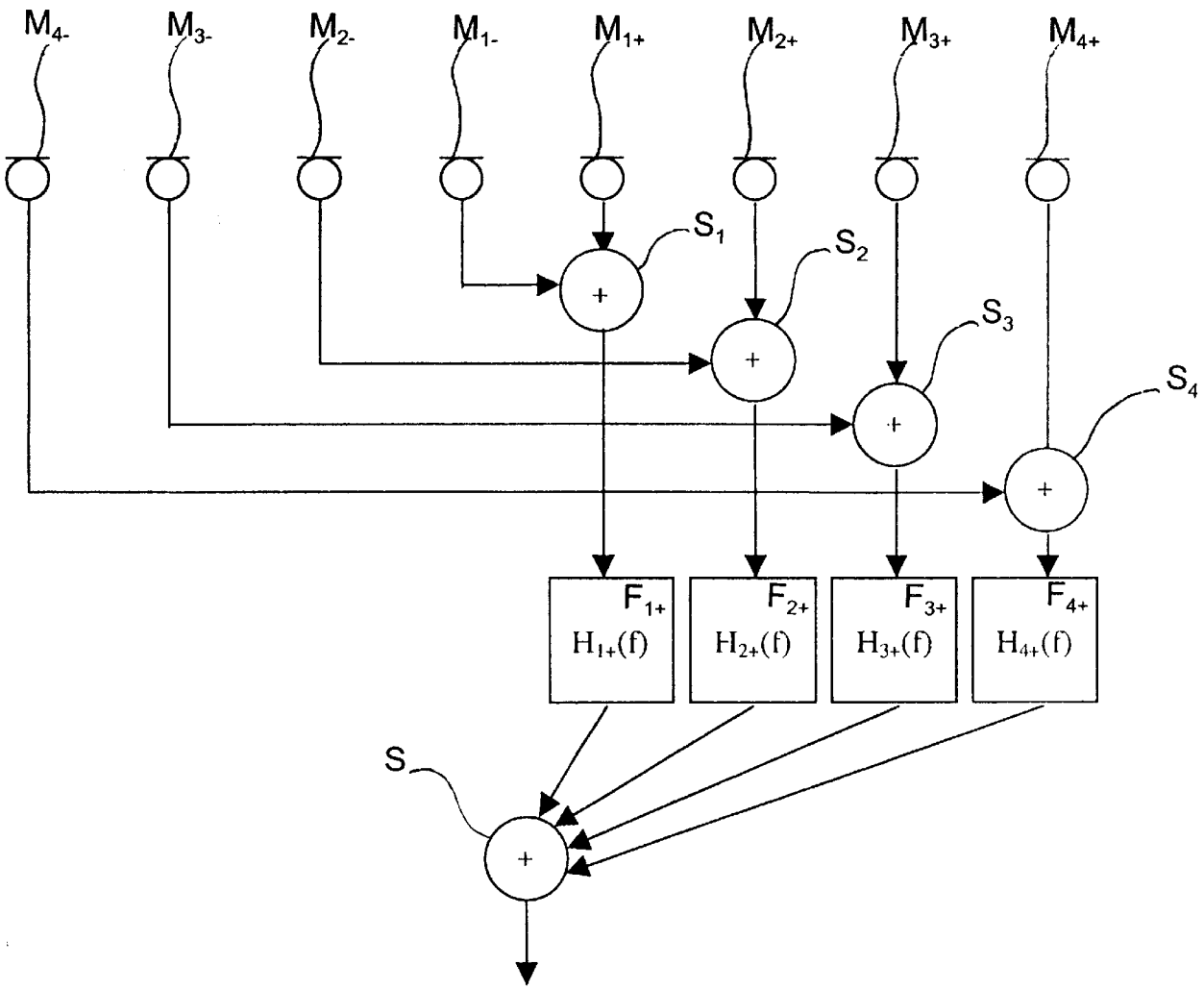
Figure 2:
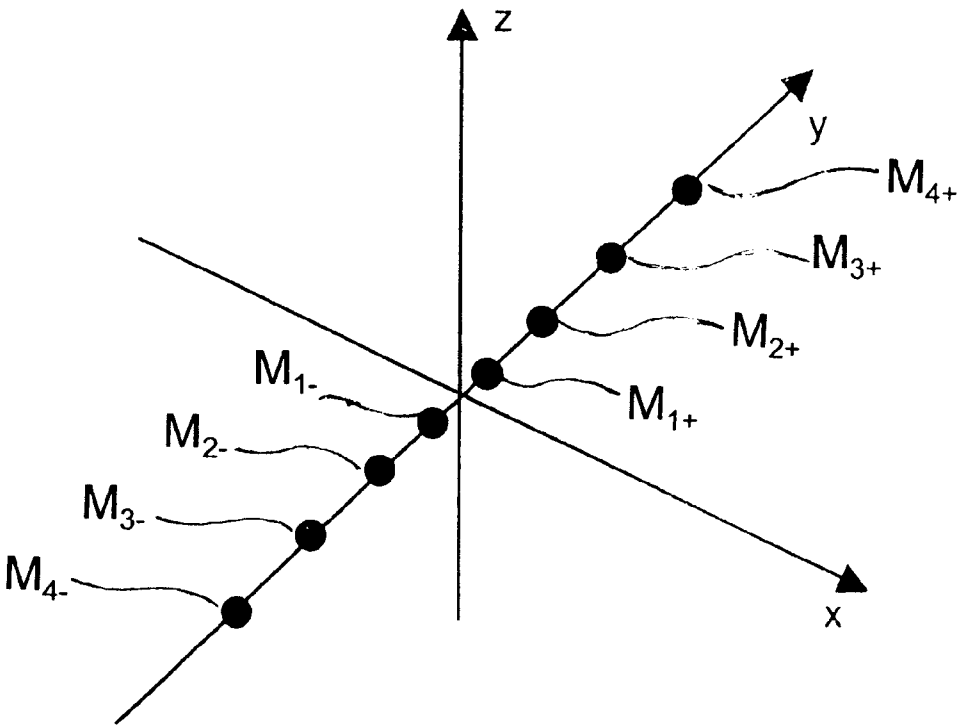
Figure 3:
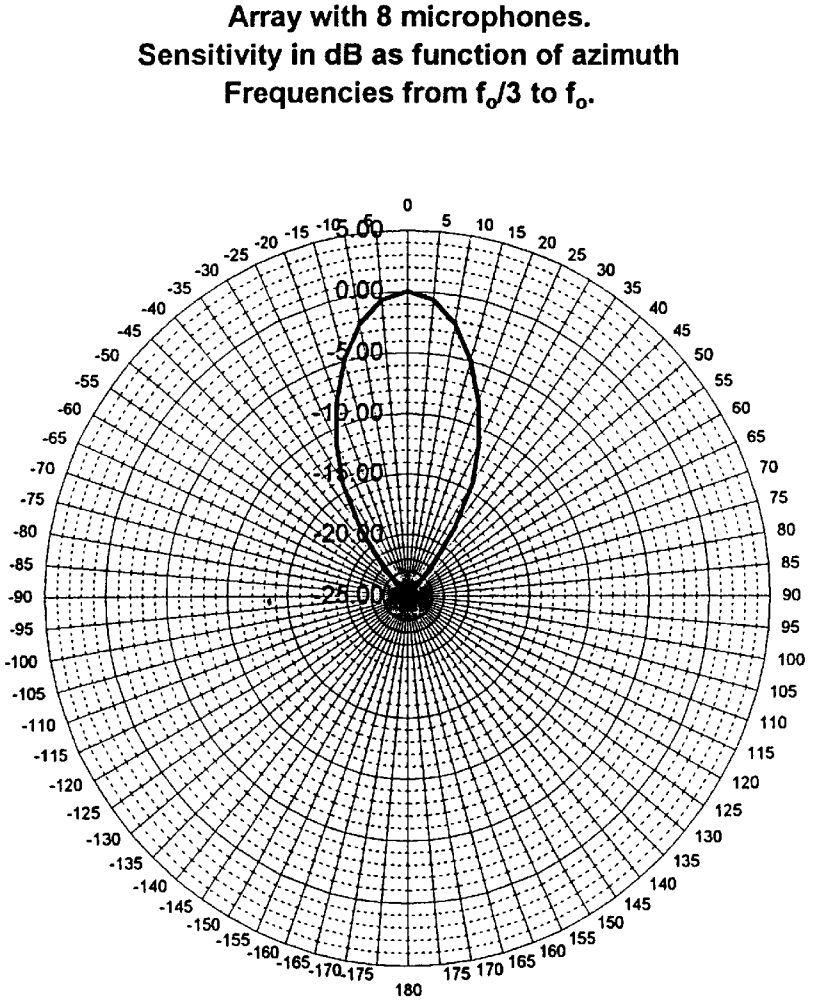
Figure 4:
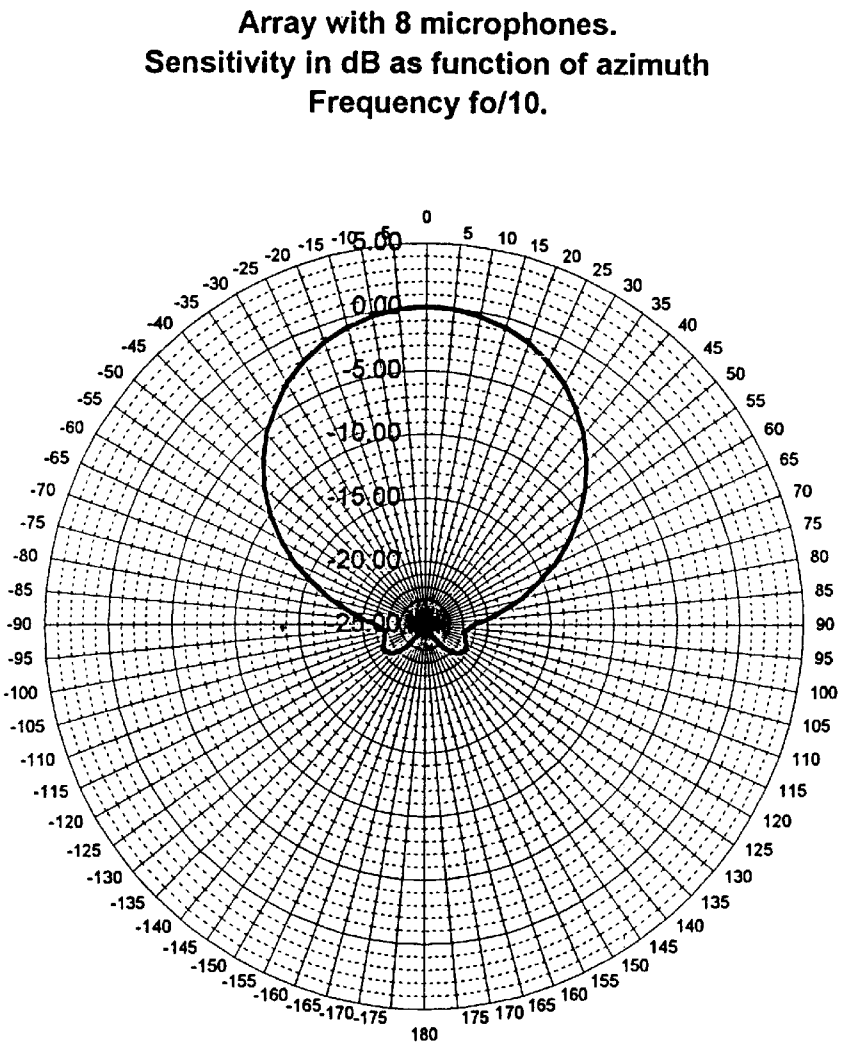

In the following, the invention will be described in more detail with reference to the drawing, where FIG. 1*a* shows a block diagram which illustrates the configuration of the microphone array according to the invention, FIG. 1*b* shows a corresponding block diagram with an alternative configuration of the microphone array according to the invention, FIG. 2 shows the positioning of the individual microphones in the microphone array in a spatial co-ordinate system, FIG. 3 shows a directional characteristic for a microphone array according to the invention, where the direction characteristic is displayed in the horizontal plane for frequencies from $f_0/3$ to $f_0$, FIG. 4 shows a directional characteristic corresponding to that shown in FIG. 3, but for the frequency $f_0/10$.

Figure 5:
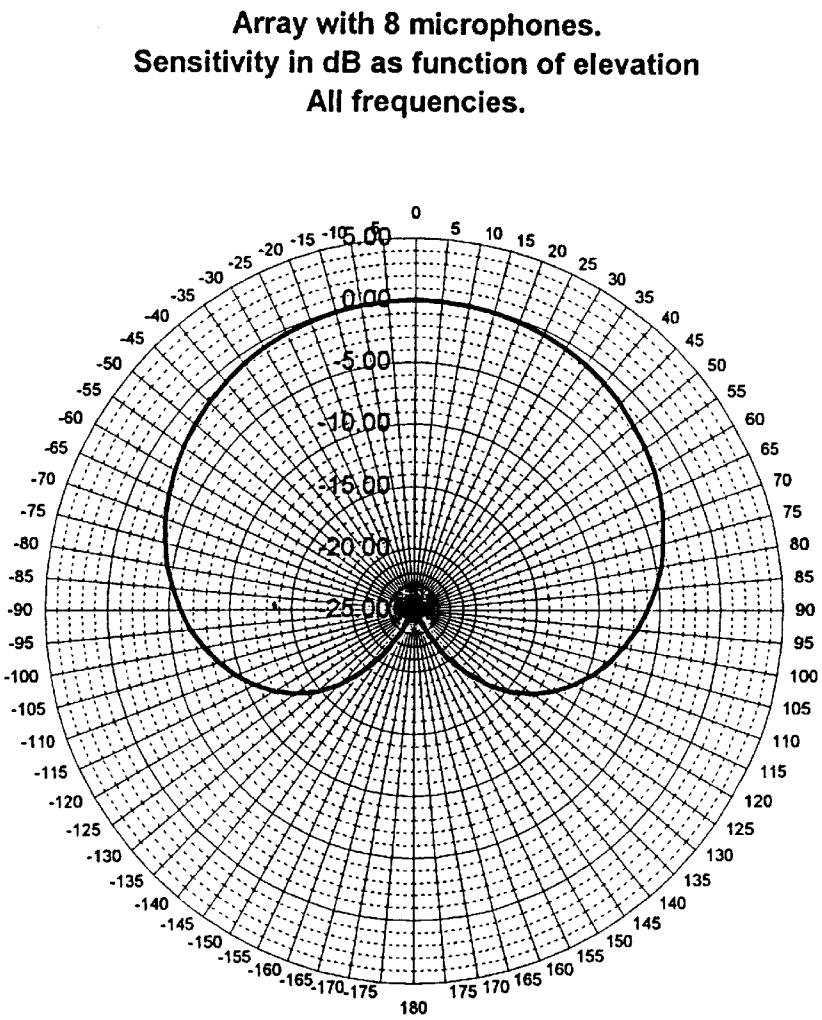
Figure 6:
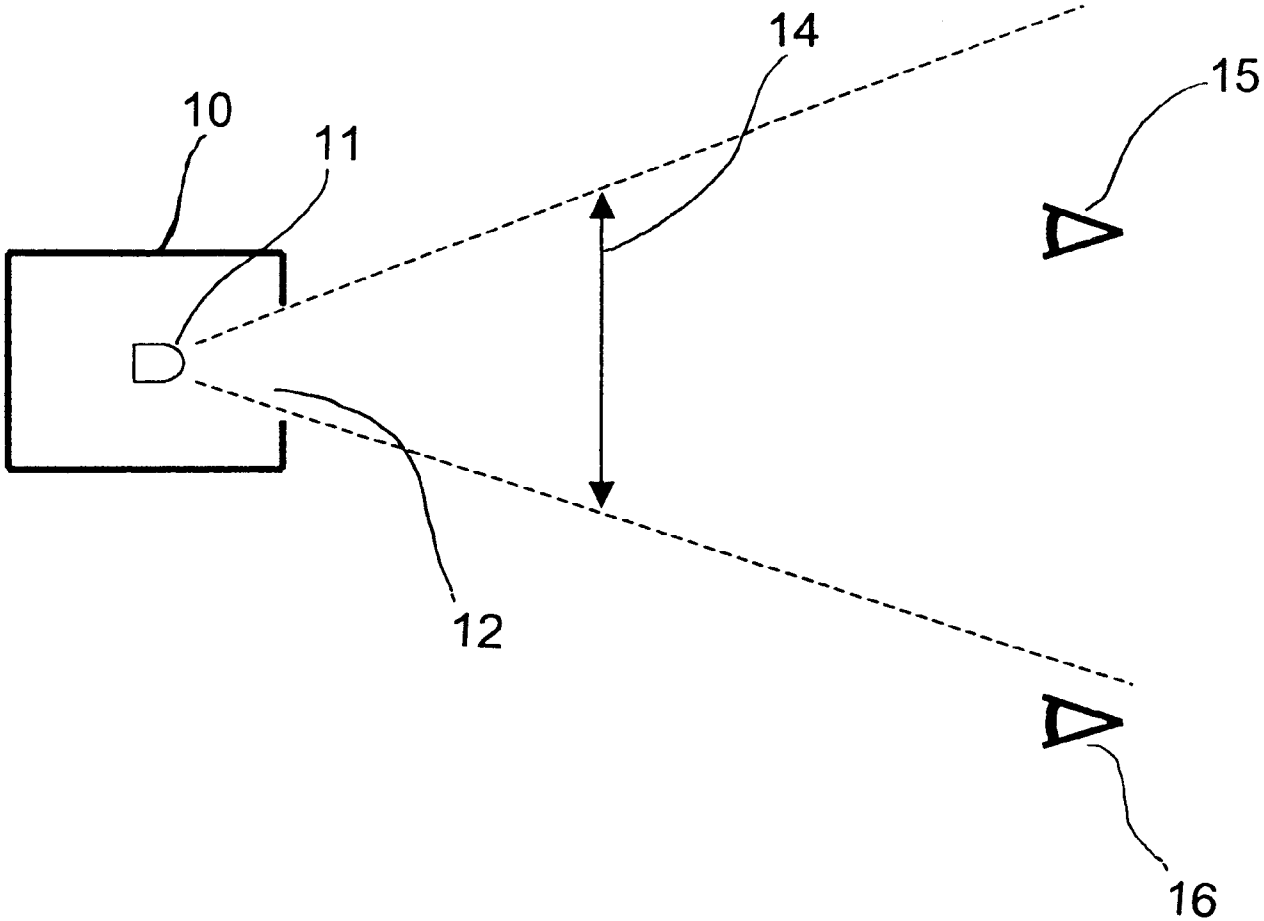

FIG. 5 shows a direction characteristic for a microphone array according to the invention, where the direction characteristic is displayed in the vertical centre plane of the microphone array, and FIG. 6 shows a section of a housing for the microphone array according to the invention, in which there is a built-in visual indicator for the indication of the array's main lobe.

A direction-determined microphone array according to the invention consists of an elongated element or housing in which a number of microphone transducers are built in a linear manner, i.e. in a row, and which in the following will be referred to as microphones. These microphones can be built into the housing so that they can receive sound from all sides, but in the embodiment which is described more closely in the following, the microphones receive sound only from the front of the microphone array, e.g. when use is made of unidirectional 1. order gradient microphones. The configuration of the directional microphone array is illustrated by means of the block diagram shown in FIG. 1*a.* This shows a number of microphones $M_{4-}$–$M_4$, which are arranged in a row, so that the pair of microphones $M_{1-}$, $M_{1+}$are disposed in the centre on each their sides of a centre plane or the centreline of the microphone array, and where the remaining pairs $M_{2-}$, $M_{2+}$, $M_{3-}$, $M_{3+}$, $M_{4-}$, $M_{4+}$ are correspondingly disposed with one microphone on each its side of the centre plane and at increasing distance from said plane. The electrical signal from each microphone is coupled to its own separate filter $F_{4-}$–$F_{4+}$, each of which has its own transfer function $H_{4-}(f)$–$H_{4+}(f)$. Each of the filters is configured as an analogue low-pass filter of the 3rd order, phase-corrected with 2nd order all-pass filter, and the output signals from the filters are fed to a summation link S which forms the final output signal for the microphone array.

The low-pass filters $F_{4-}$–$F_{4+}$ are configured so that in pairs they are identical and correspond to the paired association of the microphones. The cut-off frequencies $f_{c4-}$–$f_{c4+}$ are thus also pair-wise the same, and these are adjusted so that they decrease in relation to the position Y of the microphone pair from the centre plane.

In FIG. 1*b* there is shown an alternative way of building up the microphone circuit. Here, use is made of the symmetry in the microphone array, i.e. the fact that the filter $F_{1+}$ corresponds to the filter $F_{1-}$, the filter $F_{2+}$ corresponds to the filter $F_{2-}$ and so on. The circuit in FIG. 1*b* has the same function as the circuit in FIG. 1*a,* but the circuit can be implemented with fewer components, in that four filters are saved by the insertion of the four summation links $S_1$–$S_4$.

In FIG. 2, the positioning of the individual microphones $M_{4-}$–$M_{4+}$ in the microphone array is shown in a right-angled, three-dimensional coordinate system, in that the eight microphones are placed on the Y-axis. The individual pairs are thus placed on each their side of the X-Z plane, in that this plane forms a symmetry plane for the microphone array.

With test simulations and experiments, where both the distances Y of the microphones to the centre plane of the array and the cut-off frequencies $f_c$ are varied, a relationship has been found between these parameters, where by use of this relationship, a constant, high directivity without significant side lobes is achieved over a broad frequency range. Moreover, with these tests it has been ascertained that in an even greater frequency range there is achieved a highest possible degree of directivity.

In the table 1 below are given the approximated values which have been found for the positions Y of the microphones, and the related approximated values for the cut-off frequencies $f_c$ of the filters. The frequency values are normalized relative to a reference frequency $f_0$, which is the upper value for that frequency band in which the desired main lobe exists. Similarly, the values for the positions are normalized relative to the wavelength $L_0$ of a sound wave with the reference frequency $f_0$ in free air. In the example embodiment, the value used in the conversion between frequency and wavelengths for sound waves is c=342 m/s for the speed of sound in air. With the values shown, it is achieved that the microphone array has a constant directivity, i.e. independent of the frequency, up to an upper frequency $f_0$ for a minimum number of microphones and with an array of given length. The constant directivity is achieved from the frequency $f_0$ down to the frequency $f_0/3$. Moreover, it is achieved that the directivity is the highest possible in a frequency range from $f_0/3$ down to $f_0/10$.

TABLE 1

| Microphone | Position $Y/L_0$ | Cut-off frequency $f_c/f_0$ |
|---|---|---|
| $M_{1+}$ | 0.33 | 1.1 |
| $M_{1-}$ | −0.33 | 1.1 |
| $M_{2+}$ | 1.03 | 0.8 |
| $M_{2-}$ | −1.03 | 0.8 |
| $M_{3+}$ | 1.85 | 0.45 |
| $M_{3-}$ | −1.85 | 0.45 |
| $M_{4+}$ | 2.89 | 0.04 |
| $M_{4-}$ | −2.89 | 0.04 |

The values given in Table 1 for the cut-off frequencies of the filters can, for example, be obtained with filters whose frequency characteristics shown as magnitude and phase as a function of the frequency are as shown in the following table 2. This table describes the frequency response of the filters as magnitude (dB) and phase (degrees) from $f_0/10$ to $2f_0$.

TABLE 2

| | $H_{1-}$ and $H_{1+}$ | | $H_{2-}$ and $H_{2+}$ | | $H_{3-}$ and $H_{3+}$ | | $H_{4-}$ and $H_{4+}$ | |
|---|---|---|---|---|---|---|---|---|
| Frequency (normalized) | Magn. (dB) | Phase (degrees) | Magn. (dB) | Phase (degrees) | Magn. (dB) | Phase (degrees) | Magn. (dB) | Phase (degrees) |
| 0.100 | −23.63 | 53.7 | −25.00 | 58.6 | −28.67 | 87.3 | −12.37 | 57.7 |
| 0.125 | −22.40 | 43.4 | −23.69 | 47.4 | −27.25 | 73.7 | −14.75 | 45.4 |
| 0.160 | −21.37 | 32.7 | −22.56 | 35.6 | −25.76 | 58.8 | −17.32 | 31.6 |
| 0.200 | −20.54 | 21.6 | −21.62 | 23.1 | −24.25 | 42.1 | −20.12 | 16.1 |
| 0.250 | −19.86 | 10.1 | −20.87 | 9.8 | −22.77 | 22.4 | −23.13 | −1.4 |
| 0.315 | −19.28 | −1.8 | −20.27 | −4.6 | −21.50 | −2.3 | −26.35 | −21.7 |
| 0.400 | −18.70 | −14.6 | −19.79 | −20.9 | −21.04 | −34.4 | −29.72 | −45.7 |
| 0.500 | −17.98 | −29.2 | −19.47 | −40.4 | −22.50 | −70.5 | −33.16 | −75.8 |
| 0.630 | −16.90 | −47.3 | −19.55 | −64.8 | −25.88 | −101.0 | −36.62 | −115.4 |
| 0.800 | −15.08 | −74.6 | −20.57 | −94.6 | −30.01 | −122.5 | −40.29 | −167.4 |
| 1.000 | −13.56 | −129.8 | −23.08 | −126.3 | −34.25 | −137.7 | −44.73 | 133.6 |
| 1.250 | −19.29 | 162.3 | −26.86 | −154.8 | −38.42 | −148.9 | −49.99 | 81.5 |
| 1.600 | −27.49 | 126.5 | −31.30 | −178.8 | −42.48 | −157.6 | −55.50 | 42.3 |
| 2.000 | −35.09 | 103.3 | −36.06 | 160.1 | −46.45 | −164.9 | −61.06 | 13.3 |

With an example embodiment which is configured with the upper limiting frequency $f_0$ of 5000 Hz, and which is thus configured as shown in table 3, there is achieved a microphone array which has constant, high directivity in the range from 5000 Hz down to approx. 1670 Hz and which, moreover, has the highest possible degree of directivity from here down to approx 500 Hz, i.e. in an area in which lies a large part of the frequency range for human speech.

These filters can be directly implemented with a 3rd-order low-pass filter and a 2nd-order all-pass filter. From the point of view of circuit technique, the implementation can be carried out in numerous different ways, which on the basis of the information provided can be effected by a person skilled in the art.

TABLE 3

| Microphone | Position Y (mm) | Cut-off frequency $f_c$ (Hz) |
|---|---|---|
| $M_{1+}$ | 22.3 | 5500 |
| $M_{1-}$ | −22.3 | 5500 |
| $M_{2+}$ | 70.3 | 4000 |
| $M_{2-}$ | −70.3 | 4000 |
| $M_{3+}$ | 126 | 2300 |
| $M_{3-}$ | −126 | 2300 |
| $M_{4+}$ | 198 | 200 |
| $M_{4-}$ | −198 | 200 |

Table 4 shows the frequency characteristics for filters corresponding to the cut-off frequencies shown in table 3, in that the frequency characteristics are shown as magnitude and phase as a function of the frequency.

be seen that in this plane the main lobe covers an angle from −65 degrees to +65 degrees. All of the shown characteristics are described by the angles for −3 dB sensitivity relative to the sensitivity in the direction of the X-axis.

For the illustration of a visual indication function, in FIG. 6 there is shown a section of a housing 10 for a microphone array according to the invention. The section is taken in the vertical plane, e.g. in the centre plane, i.e. the X-Z plane. In the front of the housing 10 there is provided a light source 11 which is preferably punctiform and can consist, for example, of a light emitting diode. The front of the housing 10 is provided with an opening 12 through which the light from the light source can escape. The edges of the opening 12 are configured in such a manner that the light source can be seen from within a certain angular area, this angular area corresponding to the angular area for the main lobe for the microphone array.

In FIG. 6, the angular area 14 is shown in the vertical plane, and there is illustrated a first eye 15 which lies within the indication area, and a second eye 16 which lies outside the indication area. Normally, the distance between a user's eye and mouth, from which sound is required to be detected by the microphone array, will be insignificant compared with the distance between the microphone array and the user, so that it can be assumed that when the user can see the light source 11 through the opening 12, the user's speech will be detected by the array. It is obvious that the opening 12 can be configured along the whole of its length in such a manner that the whole of the spatial angular area for the main lobe is indicated in the same way.

TABLE 4

| | $H_{1-}$ and $H_{1+}$ | | $H_{2-}$ and $H_{2+}$ | | $H_{3-}$ and $H_{3+}$ | | $H_{4-}$ and $H_{4+}$ | |
|---|---|---|---|---|---|---|---|---|
| Frequency (Hz) | Magn. (dB) | Phase (degrees) | Magn. (dB) | Phase (degrees) | Magn. (dB) | Phase (degrees) | Magn. (dB) | Phase (degrees) |
| 500 | −23.63 | 53.7 | −25.00 | 58.6 | −28.67 | 87.3 | −12.37 | 57.7 |
| 630 | −22.40 | 43.4 | −23.69 | 47.4 | −27.25 | 73.7 | −14.75 | 45.4 |
| 800 | −21.37 | 32.7 | −22.56 | 35.6 | −25.76 | 58.8 | −17.32 | 31.6 |
| 1000 | −20.54 | 21.6 | −21.62 | 23.1 | −24.25 | 42.1 | −20.12 | 16.1 |
| 1250 | −19.86 | 10.1 | −20.87 | 9.8 | −22.77 | 22.4 | −23.13 | −1.4 |
| 1600 | −19.28 | −1.8 | −20.27 | −4.6 | −21.50 | −2.3 | −26.35 | −21.7 |
| 2000 | −18.70 | −14.6 | −19.79 | −20.9 | −21.04 | −34.4 | −29.72 | −45.7 |
| 2500 | −17.98 | −29.2 | −19.47 | −40.4 | −22.50 | −70.5 | −33.16 | −75.8 |
| 3150 | −16.90 | −47.3 | −19.55 | −64.8 | −25.88 | −101.0 | −36.62 | −115.4 |
| 4000 | −15.08 | −74.6 | −20.57 | −94.6 | −30.01 | −122.5 | −40.29 | −167.4 |
| 5000 | −13.56 | −129.8 | −23.08 | −126.3 | −34.25 | −137.7 | −44.73 | 133.6 |
| 6300 | −19.29 | 162.3 | −26.86 | −154.8 | −38.42 | −148.9 | −49.99 | 81.5 |
| 8000 | −27.49 | 126.5 | −31.30 | −178.8 | −42.48 | −157.6 | −55.50 | 42.3 |
| 10000 | −35.09 | 103.3 | −36.06 | 160.1 | −46.45 | −164.9 | −61.06 | 13.3 |

For the microphone array thus configured, there is achieved a directivity characteristic in the horizontal plane, i.e. the X-Y plane shown in FIG. 2, which is as shown in FIG. 3 for frequencies from $f_0$ down to $f_0/3$. Here it is seen that the main lobe in this plane covers an angle from −15 degrees to +15 degrees.

FIG. 4 shows a corresponding directivity characteristic recorded in the horizontal plane for the frequency $f_0/10$, and when the wavelength of the array is taken into consideration (the overall length of the array is only equal to 0.58 times the wavelength at $f_0/10$), from this it will be seen that even at this low frequency a high degree of directivity is achieved for the array, In FIG. 5 is shown the directivity characteristic for the microphone array recorded in the vertical plane, i.e. the X-Z plane shown in FIG. 2, for all frequencies, from which it will

What is claimed is:

1. A microphone array comprising:

multiple individual microphones arranged in pairs and disposed in an elongated housing, the individual microphones in each pair are disposed on opposing sides of a centerline of the microphone array and the microphones on opposing sides of the centerline are positioned at different distances from the centerline;

a summation link for summing signals from the microphones to form an output signal of the microphone array; and low pass filters operatively coupled between the microphones and the summation link, wherein associated microphone pairs are connected to low-pass filters having identical cut-off frequencies and the cut-off frequencies are different for each microphone pair, and further wherein cut-off frequencies of low-pass filters associated with microphone pairs disposed distant from the centerline are lower than cut-off frequencies of low pass filters associated with microphone pairs disposed proximate the centerline, wherein cut-off frequencies for low-pass filters associated with microphone pairs mutually correspond to distances between microphone pairs and the centerline of the microphone array.

2. The microphone array according to claim 1, wherein the microphone array has a constant directivity up to an upper frequency, and the cut-off frequency is a function of a distance of a microphone pair from the centerline of the microphone array and the distance is a function of the wavelength of the upper frequency to which there is constant directivity.

3. The microphone array according to claim 2, wherein a microphone in a microphone pair is arranged at distances Y relative to the wavelength $L_0$ from the centerline of the microphone array as follows:

$Y_{1+}=0.33\ L_0$, $Y_{1-}=0.33\ L_0$, $Y_{2+}=1.03\ L_0$, $Y_{2-}=1.03\ L_0$, $Y_{3+}=1.85\ L_0$, $Y_{3-}=1.85\ L_0$, $Y_{4+}=2.89\ L_0$, $Y_{4-}=2.89\ L_0$;

and the cut-off frequencies $f_c$ for low pass filters associated with microphones in microphone pairs are as follows:

$f_{c1+}=1.10\ f_c$ $f_{c1-}=1.10\ f_c$, $f_{c2+}=0.80\ f_c$, $f_{c2-}=0.80\ f_c$, $f_{c3+}=0.45\ f_c$, $f_{c3-}=0.45\ f_c$, $f_{c4+}=0.04\ f_c$, $f_{c4-}=0.04\ f_c$.

4. The microphone array according to claim 2, wherein the upper frequency is 5000 Hz and corresponds to a wavelength of 68.4 mm, and that the distances Y from the centerline of the microphone array to a microphone in a microphone pair is as follows:

$Y_{1+}=22.3$ mm, $Y_{1-}=-22.3$ mm, $Y_{2+}=70.3$ mm, $Y_{2-}=-70.3$ mm, $Y_{3+}=126$ mm, $Y_{3-}=-126$ mm, $Y_{4+}=198$ mm, $Y_{4-}=-198$ mm;

and the cut-off frequencies $f_c$ for low pass filters associated with microphones in the microphone pairs are as follows:

$f_{c1+}=5500$ Hz, $f_{c1-}=5500$ Hz, $f_{c2+}=4000$ Hz, $f_{c2-}=4000$ Hz, $f_{c3+}=2300$ Hz, $f_{c3-}=2300$ Hz, $f_{c4+}=200$ Hz, $f_{c4-}=200$ Hz.

5. The microphone array according to claim 2, wherein the low-pass filters are 3rd-order low-pass filters phase-corrected with 2nd-order all-pass filters by means of analog electronics.

6. The microphone array according to claim 1, wherein the microphones in the microphone array are the same type.

7. The microphone array according to claim 1, wherein the microphones are disposed in the elongated housing facing out towards one side of the housing, and an indicator is disposed in the one side of the housing, wherein the indicator informs a user that the user is in a main lobe area of the microphone array.

8. The microphone array according to claim 7, wherein the indicator is a light source disposed in a recess in the housing, wherein the recess in the housing limits distribution of light from the light source to an angular area corresponding to the main lobe area of the microphone array.

* * * * *